US006457459B1

(12) United States Patent
Schelhas et al.

(10) Patent No.: US 6,457,459 B1
(45) Date of Patent: Oct. 1, 2002

(54) FUEL SUPPLY APPARATUS FOR AN INTERNAL COMBUSTION ENGINE OF A MOTOR VEHICLE

(75) Inventors: Peter Schelhas, Stuttgart; Hans-Peter Braun, Renfrizhausen; Stefan Woerz, Vaihingen/enz, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/691,360

(22) Filed: Oct. 18, 2000

(30) Foreign Application Priority Data

Oct. 19, 1999 (DE) ..... 199 50 289

(51) Int. Cl.[7] ..... F02M 37/04
(52) U.S. Cl. ..... 123/514; 123/509
(58) Field of Search ..... 123/514, 509, 123/510, 511, 497; 137/565.34

(56) References Cited

U.S. PATENT DOCUMENTS

| | | | | |
|---|---|---|---|---|
| 4,279,232 A | | 7/1981 | Schuster et al. | |
| 4,926,829 A | * | 5/1990 | Tuckey | 123/497 |
| 5,070,849 A | * | 12/1991 | Rich et al. | 123/509 |
| 5,289,810 A | | 3/1994 | Bauer | |
| 5,749,345 A | | 5/1998 | Treml | |
| 5,791,317 A | * | 8/1998 | Eck | 123/510 |

FOREIGN PATENT DOCUMENTS

| | | |
|---|---|---|
| DE | 195 04 565 A1 | 2/1995 |
| DE | 44 04 015 A1 | 8/1995 |
| DE | 198 05 071 C1 | 8/1999 |
| DE | 198 13 172 A1 | 9/1999 |
| JP | 10-266918 | 6/1998 |
| JP | 11-254980 | 9/1999 |

* cited by examiner

*Primary Examiner*—Willis R. Wolfe
*Assistant Examiner*—Mahmoud Gimie
(74) *Attorney, Agent, or Firm*—Michael J. Striker

(57) ABSTRACT

The fuel supply apparatus has a reservoir (14) arranged within a fuel tank (12) from which fuel is drawn by a fuel feed unit (16) and supplied to an internal combustion engine (10). Unburned fuel from the internal combustion engine (10) is fed back into the fuel tank (12) via a return line (30). A control valve (34) is arranged in the return line (30), by which a connection of the return line (30) with a jet pump (38) is controlled, which supplies fuel from the fuel tank (12) to the reservoir (14). The control valve (34) has a floating body floating on the fuel in the reservoir (14) when it is nearly filled or completely filled, by which a control element of the control valve (34) is movable. When the reservoir (14) is not in its maximum filled state (hmax) the jet pump (38) is connected with the return line (30), but when the reservoir (14) is in its maximum filled state (hmax) the jet pump (38) is disconnected from the return line (30), which then opens into the reservoir (14). Overflow of fuel from the reservoir when it is filled is thereby reduced.

9 Claims, 2 Drawing Sheets

FUEL SUPPLY APPARATUS FOR AN INTERNAL COMBUSTION ENGINE OF A MOTOR VEHICLE

BACKGROUND OF THE INVENTION

1. Field of the Invention

The present invention relates to a fuel supply apparatus for an internal combustion engine and, more particularly, to a fuel supply apparatus for an internal combustion engine comprising a reservoir arranged within a fuel tank of the motor vehicle, from which fuel is drawn into a fuel feed unit and fed to an internal combustion engine, a return line, by which fuel supplied by the fuel feed unit and not burned by the internal combustion engine is fed back to the fuel tank and a jet pump connected with the return line by which fuel is fed from the fuel tank into the reservoir.

2. Prior Art

This type of fuel supply apparatus is described by DE 195 04 565 A1. This fuel supply apparatus has a reservoir arranged in a fuel tank of the motor vehicle, from which fuel is drawn into a fuel feed unit and fed to the internal combustion engine of the motor vehicle. Furthermore a return or feedback line is provided, through which unburned fuel is fed back into the fuel tank from the internal combustion engine. A jet pump is connected to the return line, through which fuel is supplied to the reservoir from the fuel tank. The jet pump guarantees that a sufficient fuel supply is present in the reservoir, from which the fuel feed unit draws fuel. The jet pump is continuously operated with the quantity of fuel fed back through the return line. When the reservoir is completely filled fuel fed back through the return line overflows from it into the fuel tank. Under certain operating conditions of the internal combustion engine, for example in the idle state or with reduced load, the fuel quantity fed back through the return line is comparatively large so that a correspondingly large amount of overflow from the reservoir results. The fuel fed back through the return line is generally more or less strongly heated, so that the total fuel volume present in the fuel tank is heated by the overflowing reservoir. This makes it difficult to satisfy certain regulations for tightness of the fuel supply tank, which control the amounts of certain environmentally harmful substances, such as hydrocarbons, which may escape from the fuel tank within a certain time interval.

SUMMARY OF THE INVENTION

It is an object of the present invention to provide an improved motor vehicle supply apparatus for an internal combustion engine of a motor vehicle that does not have the above-described disadvantage.

This object, and others which will be made more apparent hereinafter, are attained in a fuel supply apparatus for an internal combustion engine of a motor vehicle, which comprises a reservoir arranged within a fuel tank of the motor vehicle, from which fuel is drawn into a fuel feed unit and fed to an internal combustion engine; a return line, by which fuel supplied by the supply unit and not burned by the internal combustion engine is fed back to the fuel tank; and a jet pump connected with the return line by which fuel is fed from the fuel tank into the reservoir.

According to the invention a control valve is arranged in the return line upstream from the jet pump, which has a floating body which floats in fuel in the reservoir when the reservoir in nearly or completed in a filled state, which moves a control element of the control valve so that in a first position of the control element when the reservoir is not nearly in a filled state a connection is made between the jet pump and the return line and in a second position when the reservoir is at least nearly in a filled state the connection between the jet pump and the return line is broken and the return line opens into the reservoir.

The fuel supply apparatus according to the invention has the advantage that the reservoir is filled by the jet pump only if it has not yet reached the nearly or completely filled state. When the nearly or completely filled state has been reached the jet pump is disconnected and the reservoir is only filled with fuel fed back directly from the return line without passing through the jet pump so that the overflow from the reservoir is reduced and the heating of the fuel in the fuel tank is reduced. This allows the regulations regarding tightness of the fuel tank to be satisfied and maintained.

Preferred embodiments provide further advantages and features.

In a preferred embodiment of the invention the control valve is integrated or mounted in a simple manner in the reservoir or in a cover closing the reservoir. In another preferred embodiment the control element of the control valve is pressure compensated so that no or very little force acts on it in its motion direction by the pressure in the return line. Then only little force is required to move it. In an especially preferred embodiment the control element of the control valve is moved by the force of gravity into its first position. In another embodiment a pressure limiting valve is integrated into the control valve which is arranged upstream relative to the return flow.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
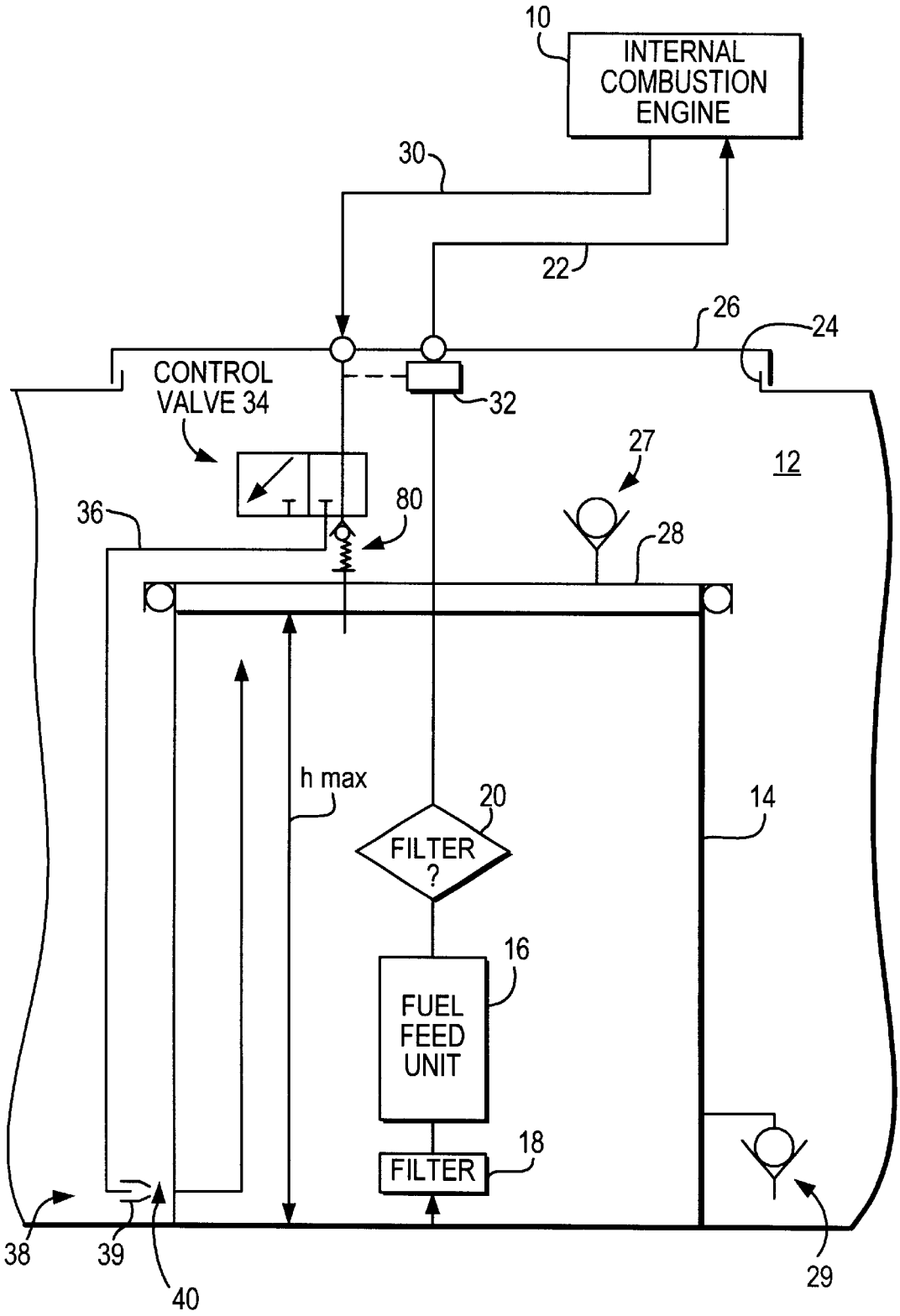
FIG. 1 is a simplified schematic flow diagram of the fuel supply apparatus according to the invention.

In FIG. 1 a fuel supply apparatus for an internal combustion engine 10 of a motor vehicle is shown in FIG. 1. The motor vehicle has a fuel tank 12, in which a pot-shaped reservoir 14 is arranged, which has a substantially smaller volume relative to the fuel tank 12. The reservoir 14 sits or rests on the bottom of the fuel tank 12. A fuel feed unit 16 is provided in the reservoir 14, by which fuel is fed to the fuel injection valves of the internal combustion engine 10 during operation from the reservoir 14. The fuel feed unit 16 comprises a pump portion and a drive portion, preferably in the form of an electric motor, which are arranged in a common housing. The fuel feed unit 16 draws fuel from the reservoir 14 through a first filter 18. An additional filter 20 can be provided on the high pressure side of the feed unit 16, through which the fuel fed from the feed unit 16 flows. A feed line 22 leads from the fuel tank 12 to the injection system of the internal combustion engine 10, through which the fuel fed from the feed unit 16 flows. The fuel tank 12 has an opening 24, through which the reservoir 14 with the feed unit 16 can be placed in the fuel tank 12 and which is covered with a cover or closure element 26. The reservoir 14 can be open on its top side, so that when the fuel tank 12 is full fuel can flow from it into the reservoir 14 through this open upper side. The reservoir can be covered on its top side also with a cover element 28. An aeration and overflow valve 27 is arranged in the cover element 28, through which air and fuel can escape when the reservoir is in its filled state. Near the bottom of the fuel tank 12 a non-return valve 29 is arranged in the reservoir 14, through which fuel can flow into the reservoir 14 from the fuel tank 14, however it prevents a flow of fuel from the reservoir 14 into the fuel tank 12.

Under the circumstance in which more fuel is supplied by the fuel feed unit 16 than is consumed by the internal combustion engine 10, a return line 30 is provided for feed back of the excess fuel. The fuel supply apparatus also can have a pressure regulator 32, by which the pressure in the fuel injection system is controlled to a predetermined value. A part of the fuel fed by the feed unit 16 is branched off by the pressure regulator 32 and is returned through the return line 30 to the fuel tank 12 (as shown by the dashed line). The pressure regulator 32 can, for example, be arranged in the fuel injection unit near the internal combustion engine 10 or near the fuel tank 12. The pressure regulator 32 can, for example, be arranged in the closure element 26 or in the cover element 28 or can be integrated in them so that the return line 30 opens directly into the fuel tank 12 and no line with greater length is required for it.

A control valve 34, which is subsequently illustrated and described in detail, is arranged in the return line 30. A line 36 connects the control valve 34 with a jet pump 38, through which fuel is fed from the fuel tank 12 into the reservoir 14. The control valve 34 is arranged upstream of the jet pump 38 in the return line 30. The jet pump 38 can, for example, be mounted in the reservoir 14 or integrated in it. The control valve 34 can, alternatively, also be mounted in the cover element 28 or integrated in it. The line 36 can be similarly arranged in the reservoir 14 or integrated in it. The jet pump 38 has a nozzle that is formed in a known and thus not further illustrated manner. A mixing chamber 40 is provided downstream of the nozzle 39, which is connected by means of at least one opening with the fuel tank 12. Fuel from the nozzle 39 travels with fuel from the fuel tank 12 so that the amount of fuel fed into the reservoir 13 is greater than the amount of fuel flowing through the line 36.

Figure 2:
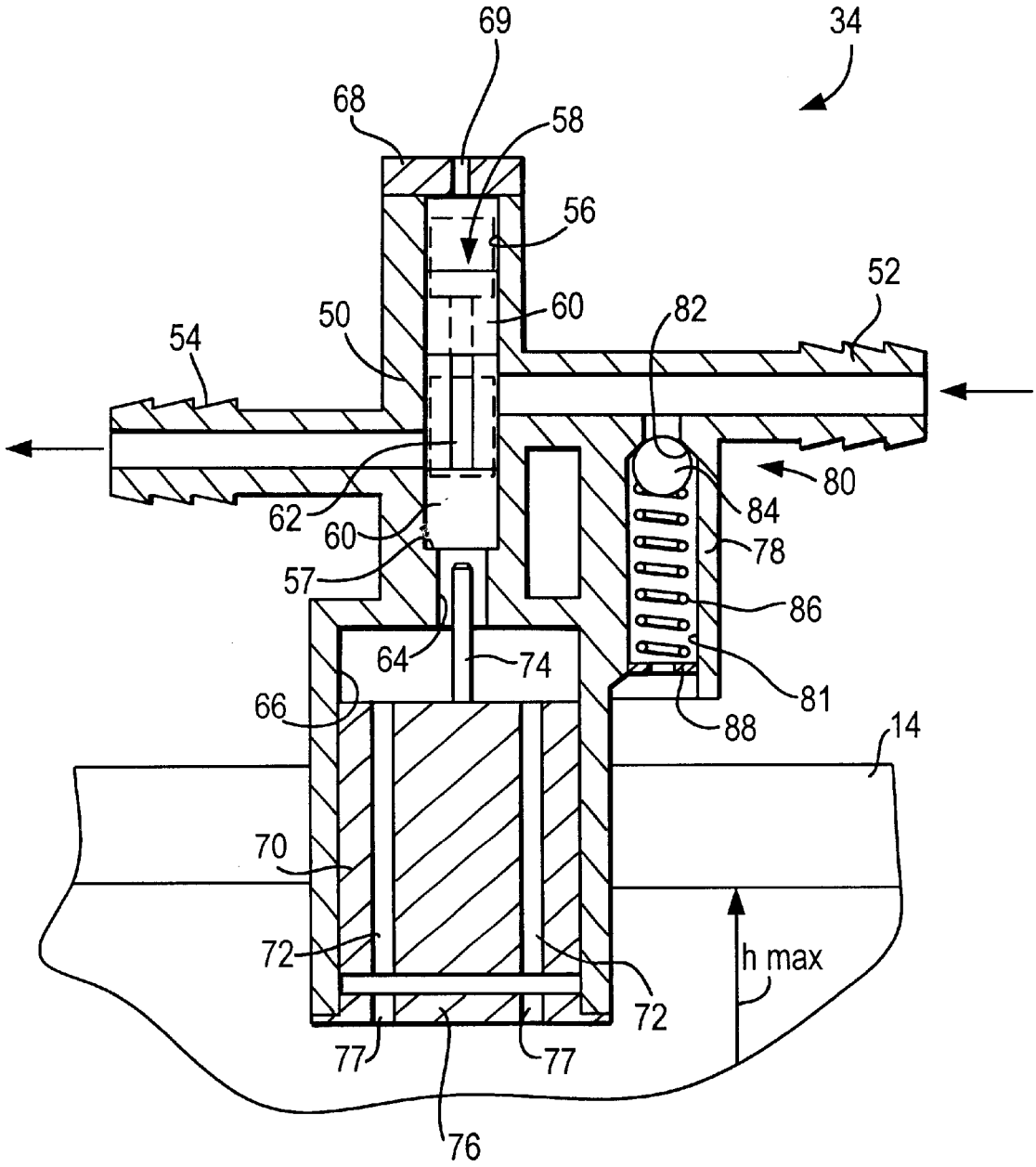
FIG. 2 is a detailed cross-sectional view through the control valve from the fuel supply apparatus shown in FIG. 1.

With the aid of FIG. 2 the control valve 34 is illustrated and described in further detail. The control valve 34 has a valve body 50, which, for example, is made from plastic material. The valve body 50 has an inlet connector 52, to which the return line 30 is connected. The valve body 50 furthermore has an outlet connector 54, to which a feed line 36 leading to the jet pump 38 is connected. Both inlet and outlet connectors 52 and 54 have a so-called tree profile on their outer casing surfaces. Both connectors 52 and 54 are, for example, arranged so that their longitudinal axes extend parallel to each other. However they are displaced or staggered from each other and the free ends of the connectors point in opposite directions from each other. In the control valve 34 assembled in the fuel tank 12 both connectors 52 and 54 extend approximately horizontal. Both inlet and outlet connectors 52 and 54 have internal horizontal passages that open into a vertical passage 56 provided in the valve body 50, which extends approximately perpendicular to the connectors 52 and 54 and thus approximately vertical in the built-in configuration of the control valve 34.

A control element 58 of the control valve 34 is guided slidably and in a sealed or leak-proof manner in the passage 56. The control element 58 has respective enlarged guiding portions 60 at its upper and lower ends, by means of which the control element 58 is guided in the passage 56 and seals the passage 56. In its central region 62 the control element 58 has a smaller cross-section than in the guiding portions 60. The control element 58 is made, for example, from plastic material or metal. Another passage 64 of a smaller diameter connects with the passage 56 at its lower end. A chamber or passage 66 with a larger diameter is connected at least approximately coaxially to itsat its lower end. A circular shoulder 57 is present at the transition from the passage 56 to the other passage 64, which forms a stop for the control element 58. At the upper end of the passage 56 it is closed by the valve cap 68. The valve cap 68 has at least one opening 69.

A floating body 70 is slidably mounted in the chamber or passage 66, whose specific gravity is less than that of the fuel, so that the floating body 70 floats on the fuel. The floating body 70 can have one or more through-going passages 72, through which fuel found in the chamber 66 can be forced during motion of the floating body 70. The floating body 70 can be a solid or hollow body and can be made of plastic material. A pin or peg 74 is connected to the floating body, which projects into the other passage 64. The lower end of the chamber 66 is closed with a chamber plug 76, which has at least one opening 77. The floating body 70 is prevented from falling from the chamber 66 by the plug 76. The control valve 34 is arranged in the fuel tank 12, so that the portion of the valve body 50 with the chamber 66, in which the floating body 70 is arranged, extends into the upper end region of the reservoir 14.

An additional pressure limiting valve 80 can be integrated in the control valve 34. An extension 78 projecting from the inlet connector 52 extends from the valve body 50. This extension is provided with a passage 81, which is connected with the horizontal passage in the inlet connector 52 and opens into the reservoir 14 outside of the valve body 50. The passage 81 is, for example, arranged so that it is at least approximately axially parallel to the passages 56 and 64 and the chamber 66 and also is next to them. A cross-sectional constriction, which, for example, can be conically shaped, is provided at the transition from the passage 81 to the passage in the inlet connector 52. A closing member 84 in the form of a movable ball is arranged in the passage 81. The closing member 84 is pressed against the pressure limiting valve seat 82 by a pre-compressed closing spring 86. The pre-compressed closing spring 86 is arranged between the closing member 84 and a spring plate 88 fixed in the passage 81. The pressure limiting valve 80 is arranged upstream of the control member 58 in the control valve 34.

The operation of the control valve 34 will be described in the following paragraphs. When the filling state of the fuel in the reservoir 14 is below a maximum filling state hmax, the floating body 70 is not lifted by the fuel in the reservoir 14 and the pin or peg 74 does not bear on the control element 58. The control element is located then in a first position in FIG. 2 shown with solid lines, in which it rests in the circular shoulder 57. The control element 58 is held by its own weight as a result of the force of gravity in the position in the circular shoulder 57. The control element 58 may also be pressed in some embodiments by a spring against the circular shoulder 57. In a first position of the control element 58 both connectors 52 and 54 (i.e. the passages through them) are connected by the passage 56 and the lower guiding portion 60 of the control element 58 is located under the outlet connector 54. The fuel flowing through the return line 30 and the inlet connector 52 thus reaches the jet pump 38 via the outlet connector 54 and the line 36. No force in this motion direction is produced on the control element 58 by the pressure existing in the return line 30, since the pressure on both guiding portions 60 acts on equal sized surface areas.

When the filling state in the reservoir increases to the maximum filling state hmax, the floating body 70 sits on the fuel, which enters through the openings 77 in the chamber plug 76, also into the chamber 66. The floating body 70 is thus raised and the pin or peg 74 moves the control element 58 upwardly. The control element 58 is then pushed into the second position shown with dashed lines in FIG. 2, in which its lower guiding portion 60 is arranged at the level or height of the outlet connector 54 and is thus closed by it. The fuel flowing to the inlet connector 52 from the return line 30 can thus no longer reach the jet pump 38. The pressure limiting valve 80 is opened by the pressure building up in the control valve 34, since its closing member 85 is raised from the valve seat 82 against the spring force of the closing spring 86. Fuel can then flow through the passage 81 directly into the reservoir 14. Then a portion of the fuel flowing back through the return line 30 is then still fed into the reservoir 14, but no additional fuel amounts are fed to the reservoir 14, such as that which would be fed through the jet pump 38. Thus only a reduced overflow of fuel occurs from the reservoir 14. When the filling state of the reservoir 14 again drops when the internal combustion engine 10 again requires more fuel, the floating body 70 drops, the control element 58 moves into its first position because of the force of gravity and the jet pump 38 is again connected to receive fuel through the return line, so that a larger amount of fuel is fed into the reservoir.

The disclosure in German Patent Application 199 50 289.7 of Oct. 19, 1999 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a fuel supply apparatus for an internal combustion engine of a motor vehicle, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention. What is claimed is new and is set forth in the following appended claims.

We claim:

1. A fuel supply apparatus for an internal combustion engine of a motor vehicle, said fuel supply apparatus comprising a fuel tank (12) arranged in the motor vehicle;

a reservoir (14) arranged within the fuel tank (12);

a fuel feed unit (16) for drawing fuel from the reservoir (14) and feeding said fuel to the internal combustion engine (10);

a return line (30) connected with the internal combustion engine (10) for feeding back a part of the fuel supplied by the fuel feed unit (16) to the internal combustion engine and not burned by the internal combustion engine to the fuel tank;

a jet pump (38) connected with the return line (30) and comprising means for feeding said part of said fuel returned from the internal combustion engine into the reservoir (14);

a control valve (34) arranged in the return line (30) upstream from the jet pump, said control valve (34) comprising a floating body (70) arranged to float in said fuel in the reservoir (14) when the reservoir in nearly or completed filled and a control element (58) connected with said floating body (70) so that said control element (58) moves when a level of said fuel in said reservoir changes, whereby in a first position of the control element (58) when the reservoir (14) is not nearly in a filled state a connection is made between the jet pump (38) and the return line (30) and in a second position when the reservoir is at least nearly in said filled state the connection between the jet pump (38) and the return line (30) is broken and the return line (30) is directly connected to said reservoir and opens into the reservoir (14).

2. The fuel supply apparatus as defined in claim 1, wherein said control valve (34) is integrated in said reservoir (14).

3. The fuel supply apparatus as defined in claim 1, further comprising a cover element (28) for the reservoir (14) and wherein said control valve (34) is integrated in said cover element (28).

4. The fuel supply apparatus as defined in claim 1, wherein said control valve (34) has a valve body (50) and said floating body (70) and said control element (58) are slidably mounted in said valve body (50).

5. The fuel supply apparatus as defined in claim 4, wherein said floating body (70) and said control element (58) are arranged at least approximately coaxial to each other in said valve body (50).

6. The fuel supply apparatus as defined in claim 1, further comprising means for pressure compensating said control element (58) so that no force due to a pressure existing in the return line (30) acts on said control element (58) in a motion direction thereof.

7. The fuel supply apparatus as defined in claim 1, wherein said control element is moved into said first position by a force of gravity acting on said control element.

8. The fuel supply apparatus as defined in claim 1, wherein said control valve (34) comprises an integrated pressure limiting valve (80) and said pressure limiting valve (80) is arranged upstream of the control element (58).

9. The fuel supply apparatus as defined in claim 8, wherein said pressure limiting valve (80) is arranged in the outlet of the control valve (34) into the reservoir (14).

* * * * *